US010851311B2

(12) United States Patent
Oneal et al.

(10) Patent No.: US 10,851,311 B2
(45) Date of Patent: Dec. 1, 2020

(54) PROCESSES FOR STABILIZING A LIQUID HYDROCARBON STREAM

(71) Applicant: UOP LLC, Des Plaines, IL (US)

(72) Inventors: Timothy Oneal, Tulsa, OK (US); Derrick Oneal, Broken Arrow, OK (US); Jeffrey Garrison, Jenks, OK (US)

(73) Assignee: UOP LLC, Des Plaines, IL (US)

( * ) Notice: Subject to any disclaimer, the term of this patent is extended or adjusted under 35 U.S.C. 154(b) by 206 days.

(21) Appl. No.: 15/887,901

(22) Filed: Feb. 2, 2018

(65) Prior Publication Data

US 2018/0155632 A1 Jun. 7, 2018

Related U.S. Application Data

(63) Continuation of application No. PCT/US2016/048515, filed on Aug. 25, 2016.

(60) Provisional application No. 62/211,398, filed on Aug. 28, 2015.

(51) Int. Cl.
*C10G 7/02* (2006.01)
*C10G 7/00* (2006.01)

(52) U.S. Cl.
CPC ..... *C10G 7/02* (2013.01); *C10G 7/00* (2013.01)

(58) Field of Classification Search
CPC ..... C10G 7/00; C10G 7/02; C10G 2300/4012
See application file for complete search history.

(56) References Cited

U.S. PATENT DOCUMENTS

| | | | | |
|---|---|---|---|---|
| 3,405,530 | A | 10/1968 | Denahan et al. | |
| 4,695,304 | A | 9/1987 | Sapper | |
| 4,702,819 | A | 10/1987 | Sharma et al. | |
| 5,513,497 | A | 5/1996 | Agrawal et al. | |
| 5,791,161 | A | 8/1998 | Manley | |
| 6,291,734 | B1 | 9/2001 | Stork | |
| 2008/0245100 | A1 | 10/2008 | Shah | |
| 2009/0120780 | A1* | 5/2009 | Wegerer | B01D 3/14 203/87 |
| 2009/0165498 | A1 | 7/2009 | Mak | |
| 2009/0188279 | A1* | 7/2009 | Bras | C10G 5/06 62/630 |

(Continued)

FOREIGN PATENT DOCUMENTS

| | | | |
|---|---|---|---|
| AU | 2003222145 | B2 | 10/2003 |
| JP | 60-092222 | A | 5/1985 |
| WO | 2009064543 | A2 | 5/2009 |

OTHER PUBLICATIONS

Wilson, "Amoco Two Tower Stabilization Process," Gas Processors Association (1984), 63rd Convention, 65-68.

(Continued)

*Primary Examiner* — Michelle Stein

(57) ABSTRACT

One or more processes for stabilizing a hydrocarbon stream. An unstabilized hydrocarbon stream comprising C5+ hydrocarbons and including some butane, propane and ethane, may be passed to a first separation zone. The first separation zone has an increased operating pressure so that a residue gas stream recovered from the first separation zone requires minimal compression for further processing. A bottoms stream form the first separation zone is passed to a second, lower pressure separation zone which provides an NGL stream and a C5+ liquid hydrocarbon stream that is stabilized.

17 Claims, 1 Drawing Sheet

(56) References Cited

U.S. PATENT DOCUMENTS

| | | | | |
|---|---|---|---|---|
| 2014/0001097 | A1 | 1/2014 | Jothy et al. | |
| 2015/0219394 | A1* | 8/2015 | Russeff | C10L 3/12 62/620 |
| 2019/0078028 | A1* | 3/2019 | Rehm | C10G 53/02 |

OTHER PUBLICATIONS

Fenglin, "Optimization of Propylene Recovery in Gas Fractionation Unit and Feasibility Study of Adopting Dual-Tower Process," Petroleum Processing and Petrochemicals (2008), 39(9), 54-57.
Mohaddecy, "Optimization of Catalyst Distribution in the Catalytic Naptha Reformer of Tehran Refinery," Petroleum & Coal (2008), 50(2), 60-68.
McCann, "Anadarko's Eagle Ford Gas Processing and Condensate Stabilization," Anadarko Petroleum Corporation (2013), 1-16.
PCT Search Report dated Nov. 24, 2016 for corresponding PCT Application No. PCT/US2016/048515.
Wolschlag et al., UOP FCC Design Advancements to Reduce Energy Consumption and CO2 Emissions, UOP LLC, 2009.
European Search Report and Opinion dated Feb. 27, 2019 for corresponding EP application EP 16 84 2624.

* cited by examiner

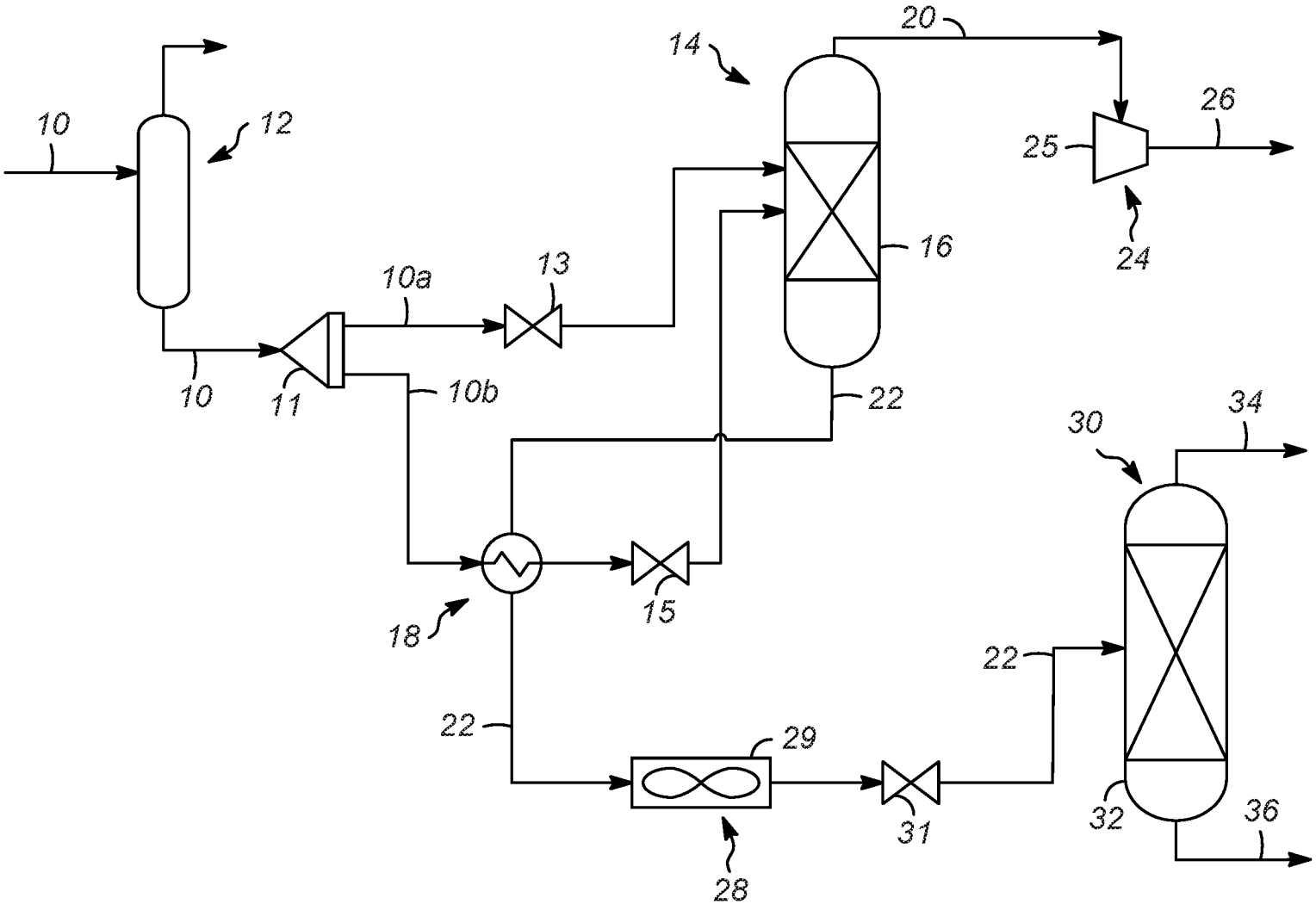
10
12
10
11
10a
10b
13
14
16
20
22
15
18
22
29
28
31
22
30
32
34
36
24
25
26

PROCESSES FOR STABILIZING A LIQUID HYDROCARBON STREAM

CROSS-REFERENCE TO RELATED APPLICATIONS

This application is a Continuation of International Application No. PCT/US2016/048515 filed Aug. 25, 2016 which application claims benefit of U.S. Provisional Application No. 62/211,398 filed Aug. 28, 2015, the contents of which cited applications are hereby incorporated by reference in their entirety.

FIELD OF THE INVENTION

This invention relates generally to processes for stabilizing a liquid hydrocarbon stream, and more particularly to processes for stabilizing a high pressure liquid hydrocarbon stream and recovering a residue gas as well as providing a liquid condensate.

BACKGROUND OF THE INVENTION

The processing and refining of natural gas liquids (NGL) which include large amounts of ethane typically involves hydrocarbon streams that are at elevated or high pressures. The elevated pressures tend to facilitate the condensation of heavier hydrocarbons (i.e., C5+ hydrocarbons), which can accumulate in conduits and piping. These liquids may be referred to as slug liquids or drip liquids.

These liquids can also include amounts of C4− hydrocarbons, making the liquids unstabilized. In order to separate the various hydrocarbon components of these accumulated liquids, these liquids can be stabilized in a condensate stabilizer tower. However, these liquids are typically supplied intermittently and at varying pressures, which can make the liquids difficult to efficiently and effectively process.

For example, the condensate stabilizer tower typically involves lowering the pressure of the liquid stream to separate a residue gas stream (comprising ethane and propane) from a stabilized condensate stream having C5+ hydrocarbons and also from a stream which comprises mostly C3 and C4 hydrocarbons. However, because the separation of these streams is accomplished at a much lower pressure (compared to the original pressure of the liquid hydrocarbon stream), the residue gas stream must be re-compressed before it can be processed further. As will be appreciated, the re-compression of the recovered residue gas stream from the condensate stabilizer tower requires a considerable amount of energy.

Therefore, it would be desirable to have processes which allows for the stabilization of these high pressure liquids without requiring the substantial re-compression associated with the processes of the prior art.

SUMMARY OF THE INVENTION

One or more processes for stabilizing such a liquid hydrocarbon stream have been invented which allow for a residue gas stream to be separated at an elevated pressure to minimize the amount of re-compression required for the further processing of same.

In a first embodiment of the invention, the present invention may be characterized broadly as providing a process for stabilizing a liquid hydrocarbon stream by: stripping a residue gas stream from an un-stabilized hydrocarbon stream in a first separation zone, the first separation zone providing a bottoms liquid stream comprising C3+ hydrocarbons; compressing the residue gas stream in a compression zone to provide a compressed residue gas stream, the compressed residue gas stream comprising light hydrocarbons; and, separating the bottoms liquid stream in a second separation zone. The second separation zone may be operated at a lower pressure than the first separation zone and the second separation zone preferably provides a C3/C4 liquid product stream and a stabilized C5+ liquid hydrocarbon stream.

In one or more embodiments of the present invention, the process includes heating a portion of the un-stabilized hydrocarbon stream before the portion of the un-stabilized hydrocarbon stream is passed to the first separation zone.

In at least one embodiment of the present invention, the process includes cooling the bottoms liquid stream from the first separation zone before the bottoms liquid stream is separated in the second separation zone.

In various embodiments of the present invention, the process includes heating a portion of the un-stabilized hydrocarbon stream before stripping the residue gas stream from the un-stabilized hydrocarbon stream. It is contemplated that the portion of the un-stabilized hydrocarbon stream is heated with the bottoms liquid stream from the first separation zone.

In some embodiments of the present invention, the process includes splitting the un-stabilized hydrocarbon stream into a first portion and a second portion before stripping the residue gas stream from the un-stabilized hydrocarbon stream. Both the first portion and the second portion may be passed to the first separation zone. It is contemplated that the process includes heating the second portion of the un-stabilized hydrocarbon stream before passing the second portion of the un-stabilized hydrocarbon stream to the first separation zone. It is further contemplated that the second portion of the un-stabilized hydrocarbon stream is heated with the bottoms liquid stream from the first separation zone. It is also contemplated that the process includes cooling the bottoms liquid stream from the first separation zone after the bottoms liquid stream has heated the second portion of the un-stabilized hydrocarbon stream.

In at least one embodiment of the present invention, the process includes filtering the un-stabilized hydrocarbon stream upstream of the first separation zone.

In a second aspect of the present invention, the present invention may be generally characterized as providing a process for stabilizing a liquid hydrocarbon stream by: passing an un-stabilized hydrocarbon stream to a first separation zone, the first separation zone configured to separate the un-stabilized hydrocarbon stream into a residue gas stream and a bottoms liquid stream comprising C3+ hydrocarbons; passing the residue gas stream to a compression zone configured to compress the residue gas stream and provide a compressed residue gas stream, the compressed residue gas stream comprising ethane and propane; and, passing the bottoms liquid stream from the first separation zone to a second separation zone. The second separation zone may be operated at a lower pressure than the first separation zone and may be configured to separate the bottoms liquid stream a C3/C4 vapor stream and a stabilized C5+ liquid hydrocarbon stream.

In one or more embodiments of the present invention, a pressure of the first separation zone is between approximately 2,482 and 3,034 kPa (360 to 440 psi), for example, 2,758 kPa (400 psi). It is contemplated that a pressure of the compressed residue gas stream zone is between approximately 6,412 and 7,377 kPa (390 psi to 1,070 psi), for example 6,895 kPa (1000 psi). It is further contemplated that a pressure of the second separation zone is between approximately 993 and 1,489 kPa (144 to 216 psi), for example 1,241 kPa (180 psi).

In some embodiments of the present invention, the process includes splitting the un-stabilized hydrocarbon stream into a first portion and a second portion, passing the first portion of the un-stabilized hydrocarbon stream to the first separation zone, heating the second portion of the un-stabilized hydrocarbon stream and then passing a heated second portion to the first separation zone. It is contemplated that the second portion of the un-stabilized hydrocarbon stream is heated with the bottoms liquid stream from the first separation zone. It is further contemplated that the second portion comprises between 60-70% by volume of the un-stabilized hydrocarbon stream.

In various embodiments of the present invention, the process includes heating at least a portion of the un-stabilized hydrocarbon stream upstream of the first separation zone with the bottoms liquid stream from the first separation zone. It is contemplated that the process includes cooling the bottoms liquid stream upstream of the second separation zone.

In at least one embodiment of the present invention, the process includes filtering the un-stabilized hydrocarbon stream upstream of the first separation zone.

Additional aspects, embodiments, and details of the invention, all of which may be combinable in any manner, are set forth in the following detailed description of the invention.

DETAILED DESCRIPTION OF THE DRAWING

One or more exemplary embodiments of the present invention will be described below in conjunction with the following drawing FIGURE, in which:

The FIGURE shows a process flow diagram of one or more embodiments of the present invention.

DETAILED DESCRIPTION OF THE INVENTION

In the present application, hydrocarbon molecules may be abbreviated C1, C2, C3 . . . Cn where "n" represents the number of carbon atoms in the one or more hydrocarbon molecules. Furthermore, a "+" or "−" may be used with an abbreviated one or more hydrocarbons notation, e.g., C3+ or C3−, which is inclusive of the abbreviated one or more hydrocarbons. As an example, the abbreviation "C3+" means one or more hydrocarbon molecules of three carbon atoms and/or more.

Additionally, in the present application, the term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column. As will be appreciated, such columns often include packing such as structured packing or packed trays for mass balance and to facilitate contact between liquids and vapors within the column.

As mentioned above, various processes for stabilizing a high pressure hydrocarbon stream have been invented in which a high pressure liquid hydrocarbon stream is initially separated into a C3+ hydrocarbon stream and a residue gas at higher pressure. This will reduce the accumulation of the heavier hydrocarbons in the system. Since the residue stream is separated off at a higher pressure, the residue stream does not require as much recompression when the residue stream is processed further, for example when the residue stream returns to the main feed of a NGL processing system such as a mechanical refrigeration or cryogenic plant. Furthermore, the residue gas is much leaner, which usually lowers the operating expense of such technologies. The C3+ product from the separation may be further separated or fractionated in a secondary separation zone which provides a bottoms stabilized liquid product and an overhead product pure.

With these general principles in mind, one or more embodiments of the present invention will be described with the understanding that the following description is not intended to be limiting.

As shown in the FIGURE, a liquid hydrocarbon stream 10 comprising C5+ hydrocarbons but also including a sufficient amount (i.e., 75% by volume) of C4− hydrocarbons so that the liquid hydrocarbon stream 10 is unstabilized may first be passed to a filtration zone 12 to remove any impurities such as water, etc. As mentioned above the liquid hydrocarbon stream 10 is typically a high pressure stream associated with the processing of liquid natural gas. Exemplary pressures for such the liquid hydrocarbon stream 10 are approximately 3,896 kPa absolute (565 psia) (+/− 10%).

In the depicted process, in order to stablish the liquid hydrocarbon stream 10, the liquid hydrocarbon stream 10 may be separated via a splitter 11 into a first portion 10*a* and a second portion 10*b*, both of which are passed to a first separation zone 14 having a separation vessel, such as a column 16. The first portion 10*a* of the liquid hydrocarbon stream 10 may preferably undergo a pressure reduction of about 1,239 kPa (165 psi), with a valve 13, for example, before being passed to the column 16. The second portion 10*b* the liquid hydrocarbon stream 10 may also undergo a pressure reduction, for example in a valve 15, of about 1,204 kPa (160 psi), preferably after being heated by approximately 44.4° C. (80° F.) in a heat exchange zone 18 by, for example, a product stream from the first separation zone 14 (discussed below). The amount of the second portion 10*b* of the liquid hydrocarbon stream 10 preferably comprises between about 60 to 70% by volume of the liquid hydrocarbon stream 10.

Additionally, as shown in the FIGURE, the first portion 10*a* of the liquid hydrocarbon stream 10 is shown being introduced into the column of the first separation zone 14 at a first location. The second portion 10*b* of the liquid hydrocarbon stream 10 is shown being introduced into the column 16 of the first separation zone 14 at a second, lower location. This is merely preferred. The portions 10*a*, 10*b* of the liquid hydrocarbon stream 10 may be recombined and introduced into the column 16 of the first separation zone 14 as a combined stream. Furthermore, the liquid hydrocarbon stream 10 may be split into more than two streams.

In the column 16 of the first separation zone 14, the lighter hydrocarbon components of the liquid hydrocarbon stream 10, mostly methane, ethane, and propane, will be separated from propane and heavier components. Accordingly, in some embodiments of the present invention, the first separation zone 14 is stripping zone. The lighter hydrocarbons may be recovered from the first separation zone 14 as a residue gas stream 20. The heavier components of the liquid hydrocarbon stream 10 may be recovered from the first separation zone as a bottoms liquid stream 22 comprising a C3+ hydrocarbons stream which may utilize a reboiler system (not shown). The column 16 of the first separation zone 14 typically has an operating temperature of approximately 43.3° C. (110° F.) and a pressure between approximately 2,482 and 3,034 kPa (360 to 440 psi), for example, 2,758 kPa (400 psi).

The residue gas stream 20 from the first separation zone 14 may be compressed in a compression zone 24 having, for example a compressor 25, and a compressed residue gas stream 26 may be passed to the feed of a recovery process or combined with another stream and passed to a recovery process (not shown). Preferably the pressure of the residue gas stream 20 is increased to between approximately 6,412 and 7,377 kPa (390 psi to 1,070 psi), for example 6,895 kPa (1,000 psi). Since the first separation zone 14 is operated at a higher pressure compared to conventional processes, less compression stages will be required. This can lower utility costs associated with the compression of the residue gas stream 20 and can also lower capital costs since less equipment may be required.

Returning to the FIGURE, the bottoms liquid stream 22 from the first separation zone 14 may be used to heat the second portion 10*b* of the liquid hydrocarbon stream 10 in the heat exchange zone 18, as discussed above. From the heat exchange zone 18, the bottoms liquid stream 22 may be cooled in a cooling zone 28 having, for example, an air cooler 29. In addition to being cooled, by for example 44.4° C. (80° F.) in the cooling zone 28, the pressure of the bottoms liquid stream 22 may be reduced, for example by about 998 kPa (130 psi) by, for example, a valve 31, and then the bottoms liquid stream 22 may be passed to a second separation zone 30.

The second separation zone 30 also has a separation vessel, such as a column 32 having an operating pressure and temperature of between approximately 993 and 1,489 kPa (144 to 216 psi), for example 1,241 kPa (180 psi), and about 80.5° C. (177° F.), respectively. The pressure of the second separation zone 30 is preferably less than the pressure in the first separation zone 14.

In the column 32 of the second separation zone 30, the components of the bottoms liquid stream 22 will separate into a C3/C4 stream 34 comprising C3 and C4 hydrocarbons, and a stabilized C5+ product stream 36 (sometimes referred to as a stabilized condensate or an RVP product). The C3/C4 stream 34 may utilize an air cooled reflux accumulator system, may be treated to remove contaminants like hydrogen sulfide and oxygenates, and then may be processed further as is known, for example by being separated into various streams by fractionation. Additionally, the stabilized C5+ product stream 36 may utilized a reboiler system (no shown) and then be processed further as is known.

By utilizing the two separation zones, the pressure of the residue gas stream can be maintained during the stabilization, and the separation of the C3/C4 stream and the stabilized C5+ product stream can be improved. Additionally, by stabilizing and recovering the residue gas stream at a relatively higher pressure (compared to conventional processes), the residue gas stream may have an increased purity and will require less compression compared to conventional processes.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

Specific Embodiments

While the following is described in conjunction with specific embodiments, it will be understood that this description is intended to illustrate and not limit the scope of the preceding description and the appended claims.

A first embodiment of the invention is a process for stabilizing a liquid hydrocarbon stream, the process comprising stripping a residue gas stream from an un-stabilized hydrocarbon stream in a first separation zone, the first separation zone providing a bottoms liquid stream comprising C3+ hydrocarbons; compressing the residue gas stream in a compression zone to provide a compressed residue gas stream, the compressed residue gas stream comprising light hydrocarbons; and, separating the bottoms liquid stream in a second separation zone, the second separation zone being operated at a lower pressure than the first separation zone, the second separation zone providing a C3/C4 liquid product stream and a stabilized C5+ liquid hydrocarbon stream. An embodiment of the invention is one, any or all of prior embodiments in this paragraph up through the first embodiment in this paragraph further comprising heating a portion of the un-stabilized hydrocarbon stream before the portion of the un-stabilized hydrocarbon stream is passed to the first separation zone. An embodiment of the invention is one, any or all of prior embodiments in this paragraph up through the first embodiment in this paragraph further comprising cooling the bottoms liquid stream from the first separation zone before the bottoms liquid stream is separated in the second separation zone. An embodiment of the invention is one, any or all of prior embodiments in this paragraph up through the first embodiment in this paragraph further comprising heating a portion of the un-stabilized hydrocarbon stream before stripping the residue gas stream from the un-stabilized hydrocarbon stream. An embodiment of the invention is one, any or all of prior embodiments in this paragraph up through the first embodiment in this paragraph wherein the portion of the un-stabilized hydrocarbon stream is heated with the bottoms liquid stream from the first separation zone. An embodiment of the invention is one, any or all of prior embodiments in this paragraph up through the first embodiment in this paragraph further comprising splitting the un-stabilized hydrocarbon stream into a first portion and a second portion before stripping the residue gas stream from the un-stabilized hydrocarbon stream, wherein both the first portion and the second portion are passed to the first separation zone. An embodiment of the invention is one, any or all of prior embodiments in this paragraph up through the first embodiment in this paragraph further comprising heating the second portion of the un-stabilized hydrocarbon stream before passing the second portion of the un-stabilized hydrocarbon stream to the first separation zone. An embodiment of the invention is one, any or all of prior embodiments in this paragraph up through the first embodiment in this paragraph wherein the second portion of the un-stabilized hydrocarbon stream is heated with the bottoms liquid stream from the first separation zone. An embodiment of the invention is one, any or all of prior embodiments in this paragraph up through the first embodiment in this paragraph further comprising cooling the bottoms liquid stream from the first separation zone after the bottoms liquid stream has heated the second portion of the un-stabilized hydrocarbon stream. An embodiment of the invention is one, any or all of prior embodiments in this paragraph up through the first embodiment in this paragraph further comprising filtering the un-stabilized hydrocarbon stream upstream of the first separation zone.

A second embodiment of the invention is a process for stabilizing a liquid hydrocarbon stream, the process comprising passing an un-stabilized hydrocarbon stream to a first separation zone, the first separation zone configured to separate the un-stabilized hydrocarbon stream into a residue gas stream and a bottoms liquid stream comprising C3+ hydrocarbons; passing the residue gas stream to a compression zone configured to compress the residue gas stream and provide a compressed residue gas stream, the compressed residue gas stream comprising methane, ethane, and propane; and, passing the bottoms liquid stream from the first separation zone to a second separation zone, the second separation zone being operated at a lower pressure than the first separation zone, the second separation zone configured to separate the bottoms liquid stream a C3/C4 stream and a stabilized C5+ liquid hydrocarbon stream. An embodiment of the invention is one, any or all of prior embodiments in this paragraph up through the second embodiment in this paragraph wherein a pressure of the first separation zone is between approximately 2,482 and 3,034 kPa (360 to 440 psi). An embodiment of the invention is one, any or all of prior embodiments in this paragraph up through the second embodiment in this paragraph wherein a pressure of the compressed residue gas stream zone is between approximately 6,412 and 7,377 kPa (390 psi to 1,070 psi). An embodiment of the invention is one, any or all of prior embodiments in this paragraph up through the second embodiment in this paragraph wherein a pressure of the second separation zone is between approximately 993 and 1,489 kPa (144 to 216 psi). An embodiment of the invention is one, any or all of prior embodiments in this paragraph up through the second embodiment in this paragraph further comprising splitting the un-stabilized hydrocarbon stream into a first portion and a second portion; and, passing the first portion of the un-stabilized hydrocarbon stream to the first separation zone; heating the second portion of the un-stabilized hydrocarbon stream and then passing a heated second portion to the first separation zone. An embodiment of the invention is one, any or all of prior embodiments in this paragraph up through the second embodiment in this paragraph wherein the second portion of the un-stabilized hydrocarbon stream is heated with the bottoms liquid stream from the first separation zone. An embodiment of the invention is one, any or all of prior embodiments in this paragraph up through the second embodiment in this paragraph wherein the second portion comprises between 60-70% by volume of the un-stabilized hydrocarbon stream. An embodiment of the invention is one, any or all of prior embodiments in this paragraph up through the second embodiment in this paragraph further comprising heating at least a portion of the un-stabilized hydrocarbon stream upstream of the first separation zone with the bottoms liquid stream from the first separation zone. An embodiment of the invention is one, any or all of prior embodiments in this paragraph up through the second embodiment in this paragraph further comprising cooling the bottoms liquid stream upstream of the second separation zone. An embodiment of the invention is one, any or all of prior embodiments in this paragraph up through the second embodiment in this paragraph further comprising filtering the un-stabilized hydrocarbon stream upstream of the first separation zone.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for stabilizing a liquid hydrocarbon stream, the process comprising:

stripping a residue gas stream from an un-stabilized hydrocarbon stream in a first separation zone, the first separation zone operating at a pressure between 2,482 kPa and 3,034 kPa and providing a bottoms liquid stream comprising C3+ hydrocarbons;

compressing the residue gas stream in a compression zone to provide a compressed residue gas stream having a pressure between 6,412 kPa and 7,377 kPa, the compressed residue gas stream comprising light hydrocarbons; and separating the bottoms liquid stream in a second separation zone operating at a pressure between 993 kPa and 1,489 kPa, the second separation zone being operated at a lower pressure than the first separation zone, the second separation zone providing a C3/C4 liquid product stream and a stabilized C5+ liquid hydrocarbon stream.

2. The process of claim 1 further comprising: heating a portion of the un-stabilized hydrocarbon stream before the portion of the un-stabilized hydrocarbon stream is passed to the first separation zone.

3. The process of claim 1 further comprising: cooling the bottoms liquid stream from the first separation zone before the bottoms liquid stream is separated in the second separation zone.

4. The process of claim 1 further comprising: heating a portion of the un-stabilized hydrocarbon stream before stripping the residue gas stream from the un-stabilized hydrocarbon stream.

5. The process of claim 4 wherein the portion of the un-stabilized hydrocarbon stream is heated with the bottoms liquid stream from the first separation zone.

6. The process of claim 1 further comprising: splitting the un-stabilized hydrocarbon stream into a first portion and a second portion before stripping the residue gas stream from the un-stabilized hydrocarbon stream, wherein both the first portion and the second portion are passed to the first separation zone.

7. The process of claim 6 further comprising: heating the second portion of the un-stabilized hydrocarbon stream before passing the second portion of the un-stabilized hydrocarbon stream to the first separation zone.

8. The process of claim 7 wherein the second portion of the un-stabilized hydrocarbon stream is heated with the bottoms liquid stream from the first separation zone.

9. The process of claim 8 further comprising: cooling the bottoms liquid stream from the first separation zone after the bottoms liquid stream has heated the second portion of the un-stabilized hydrocarbon stream.

10. The process of claim 1 further comprising: filtering the un-stabilized hydrocarbon stream upstream of the first separation zone.

11. A process for stabilizing a liquid hydrocarbon stream, the process comprising:

passing an un-stabilized hydrocarbon stream to a first separation zone, the first separation zone being operated at a pressure between 2,482 kPa and 3,034 kPa and configured to separate the un-stabilized hydrocarbon stream into a residue gas stream and a bottoms liquid stream comprising C3+ hydrocarbons;

passing the residue gas stream to a compression zone configured to compress the residue gas stream and provide a compressed residue gas stream having a pressure between 6,412 kPa and 7,377 kPa, the compressed residue gas stream comprising methane, ethane, and propane; and passing the bottoms liquid stream from the first separation zone to a second separation zone, the second separation zone being operated at a pressure between 993 kPa and 1,489 kPa, which is lower than pressure in the first separation zone, the second separation zone configured to separate the bottoms liquid stream a C3/C4 stream and a stabilized C5+ liquid hydrocarbon stream.

12. The process of claim 11 further comprising:

splitting the un-stabilized hydrocarbon stream into a first portion and a second portion; and passing the first portion of the un-stabilized hydrocarbon stream to the first separation zone;

heating the second portion of the un-stabilized hydrocarbon stream and then passing a heated second portion to the first separation zone.

13. The process of claim 12 wherein the second portion of the un-stabilized hydrocarbon stream is heated with the bottoms liquid stream from the first separation zone.

14. The process of claim 12 wherein the second portion comprises between 60-70% by volume of the un-stabilized hydrocarbon stream.

15. The process of claim 11 further comprising: heating at least a portion of the un-stabilized hydrocarbon stream upstream of the first separation zone with the bottoms liquid stream from the first separation zone.

16. The process of claim 11 further comprising: cooling the bottoms liquid stream upstream of the second separation zone.

17. The process of claim 11 further comprising: filtering the un-stabilized hydrocarbon stream upstream of the first separation zone.

* * * * *